United States Patent [19]

Smith

[11] Patent Number: 4,505,244

[45] Date of Patent: Mar. 19, 1985

[54] FUEL INJECTION SYSTEM

[75] Inventor: Edward D. Smith, Greensburg, Ind.

[73] Assignee: Cummins Engine Company, Inc., Columbus, Ind.

[21] Appl. No.: 375,661

[22] Filed: May 6, 1982

[51] Int. Cl.[3] ..... F02M 47/02; F02M 45/06

[52] U.S. Cl. ..... 123/447; 123/575; 123/300; 123/501; 417/387; 417/386

[58] Field of Search ..... 123/447, 575, 500, 501, 123/515, 390, 504, 506, 446, 299, 300; 417/383, 385, 386, 387

[56] References Cited

U.S. PATENT DOCUMENTS

| | | | |
|---|---|---|---|
| 2,078,286 | 4/1937 | Seagren | 123/501 |
| 2,343,962 | 3/1944 | Dodson | 417/387 |
| 2,810,375 | 10/1957 | Froehlich | 123/501 |
| 3,003,421 | 10/1961 | Bessiere | 417/387 |
| 3,050,001 | 8/1962 | Links | 417/386 |
| 3,083,912 | 4/1963 | Shallenberg | 123/501 |
| 4,069,800 | 1/1978 | Kanda | 123/447 |
| 4,134,549 | 1/1979 | Perr | 123/501 |
| 4,182,492 | 1/1980 | Albert | 239/92 |
| 4,216,754 | 8/1980 | Lakra | 123/447 |
| 4,222,358 | 9/1980 | Hofbauer | 239/92 |
| 4,259,040 | 3/1981 | Scheying | 123/300 |
| 4,273,087 | 6/1981 | Goloff | 123/575 |
| 4,367,706 | 1/1983 | Scheying | 123/300 |
| 4,440,134 | 4/1984 | Nakao | 123/447 |

FOREIGN PATENT DOCUMENTS

| | | | |
|---|---|---|---|
| 741842 | 11/1943 | Fed. Rep. of Germany | 417/387 |
| 851570 | 10/1952 | Fed. Rep. of Germany | 123/300 |

*Primary Examiner*—Charles J. Myhre
*Assistant Examiner*—Carl Stuart Miller
*Attorney, Agent, or Firm*—Neuman, Williams, Anderson & Olson

[57] ABSTRACT

A fuel injection system is provided for a multicylinder internal combustion engine. Each cylinder is provided with at least one fuel injector. The system includes a cam-operated pumping plunger which maintains fluid pressure within an accumulator and controls the intermittent application of fluid pressure from the accumulator through a first chamber in which the plunger moves to one end of a metering plunger. The opposite end of the metering plunger coacts with a second chamber in which the metering plunger moves to define a cavity into which fuel is supplied for subsequent feeding to the cylinder injector. Fuel enters the cavity during those periods when the metering plunger is not subjected to the accumulator fluid pressure, the latter being under the control of the pumping plunger. The pumping plunger reciprocates within its chamber and is rotatable about its longitudinal axis. An elongated groove is formed in and encompasses the exterior of the pumping plunger. The effective axial length of the groove may be varied depending upon the relative position of rotation of the pumping plunger within the first chamber, so that the time may be changed as to when the accumulator fluid pressure is intermittently supplied to the metering plunger via the first chamber and during the pumping stroke of the plunger. The rotational adjustment of the pumping plunger is controlled by external means which may be responsive to the operational demands of the engine.

23 Claims, 8 Drawing Figures

FIG. 4
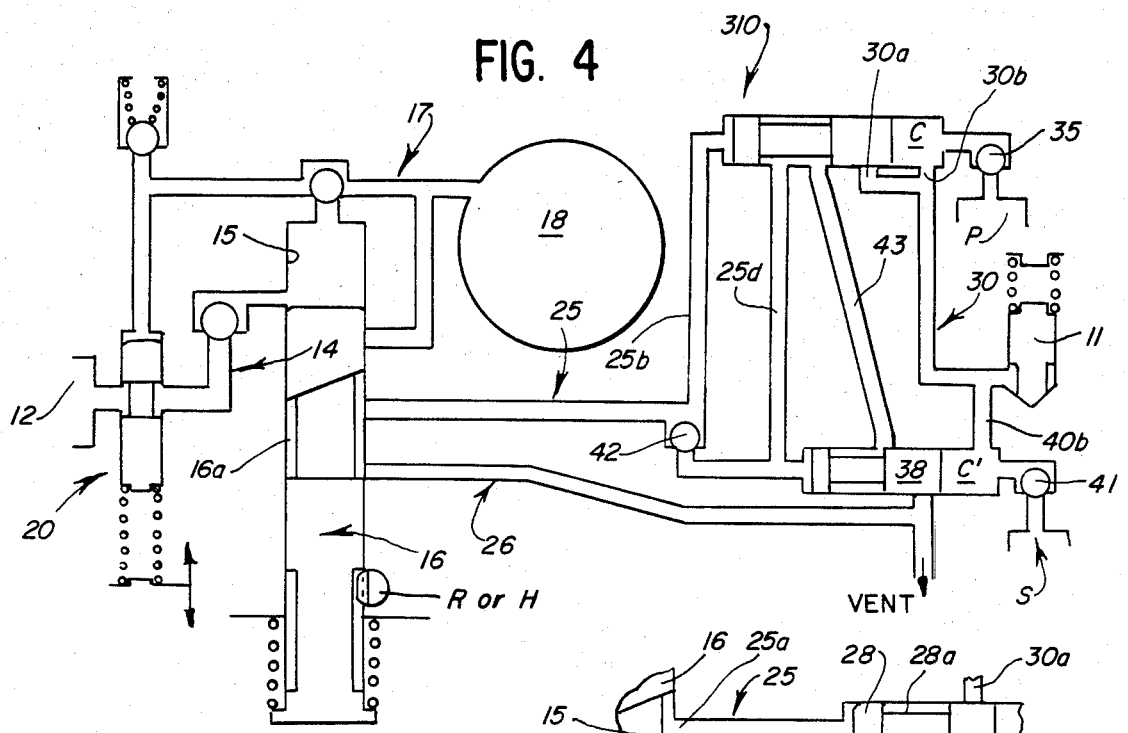
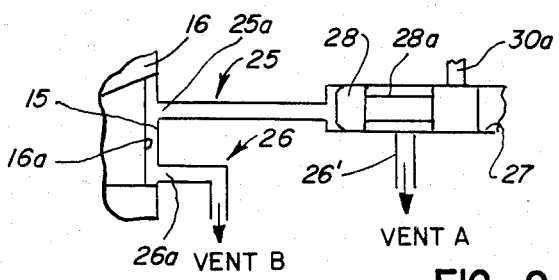
FIG. 8
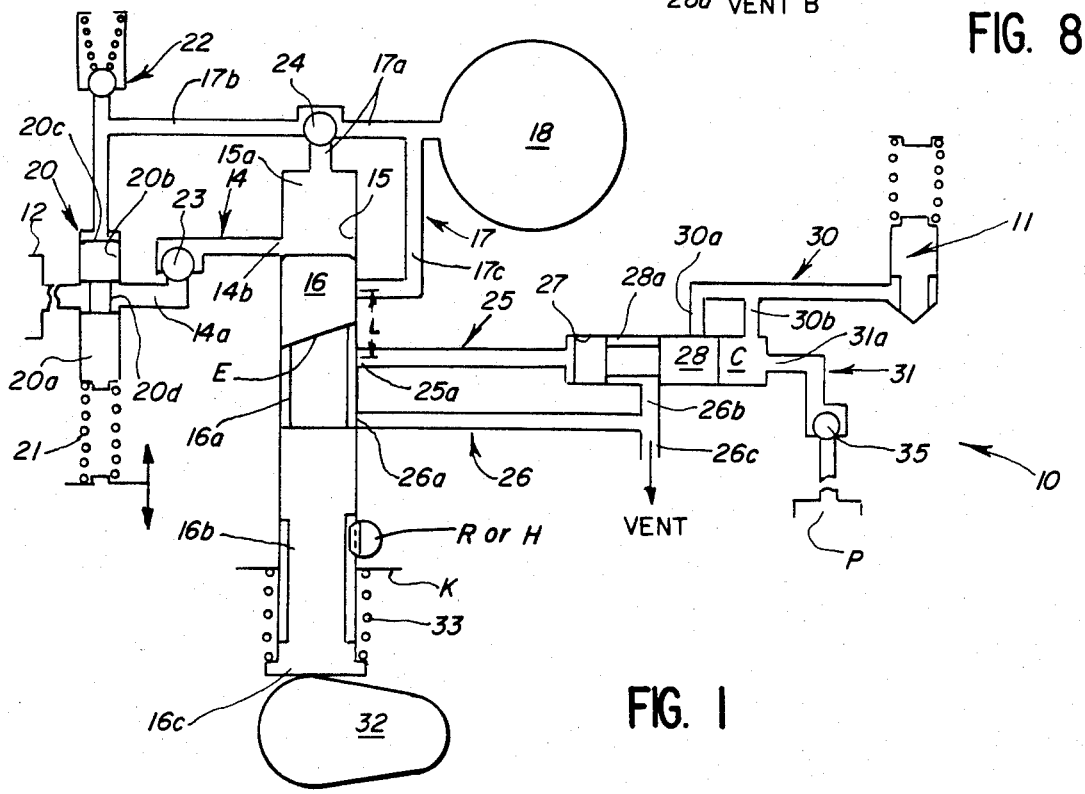
FIG. 1

FIG. 2
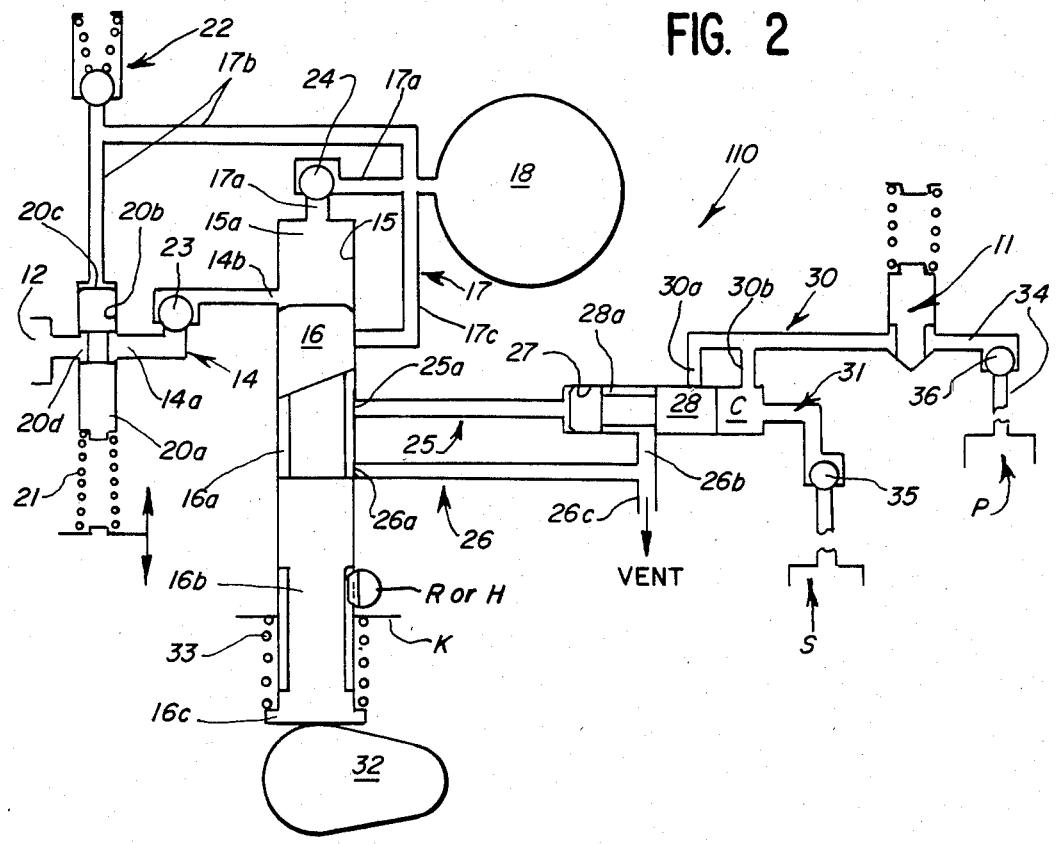
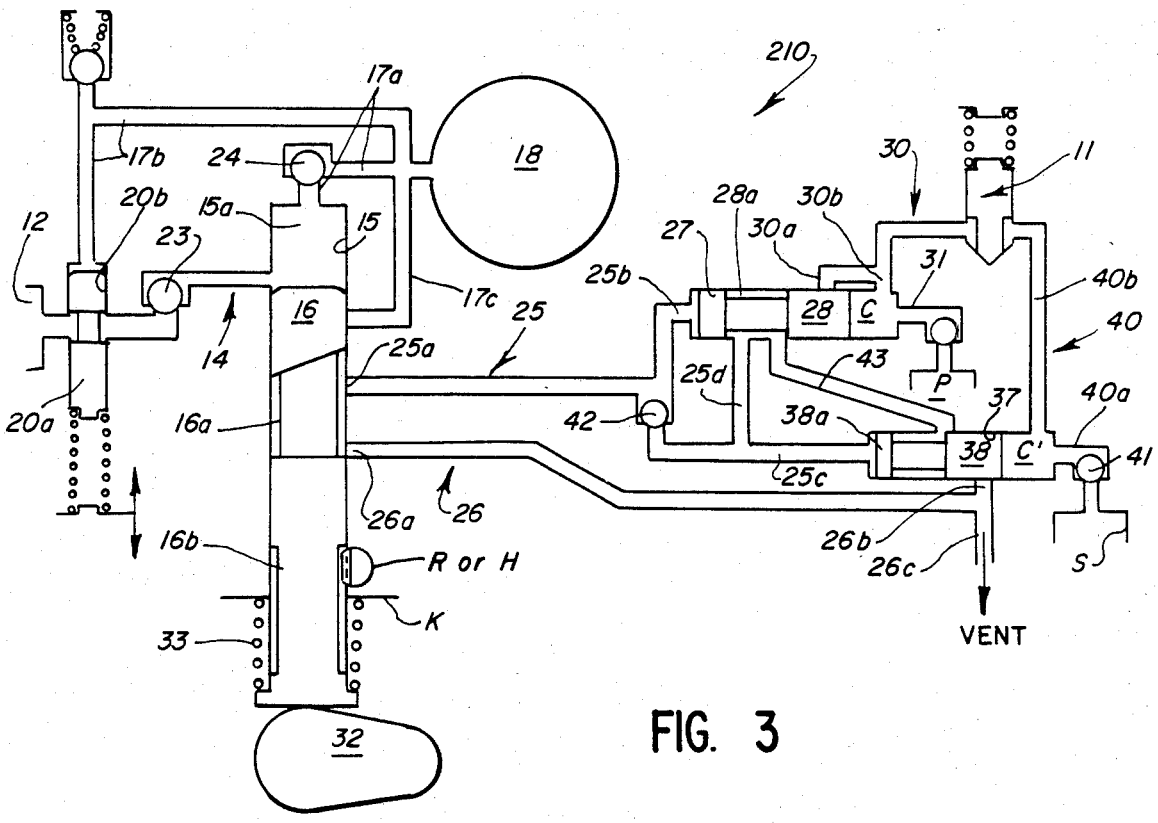
FIG. 3

FIG. 5
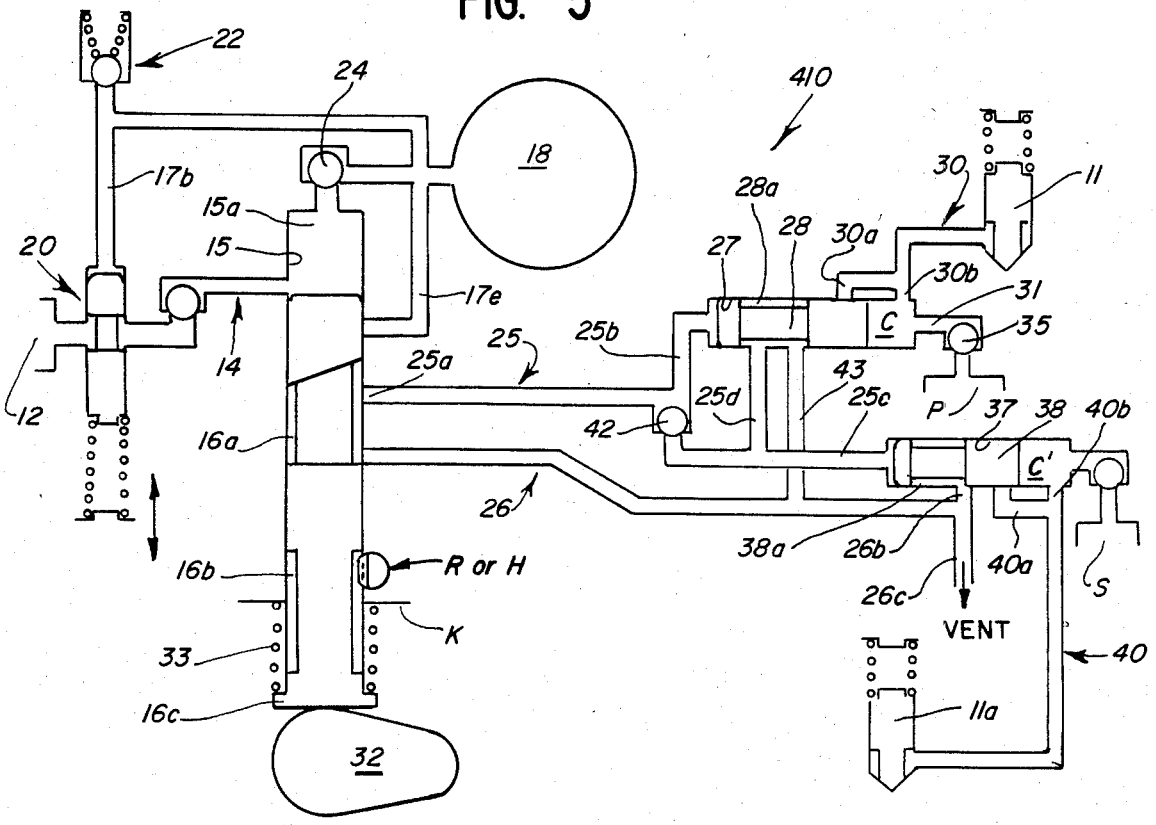
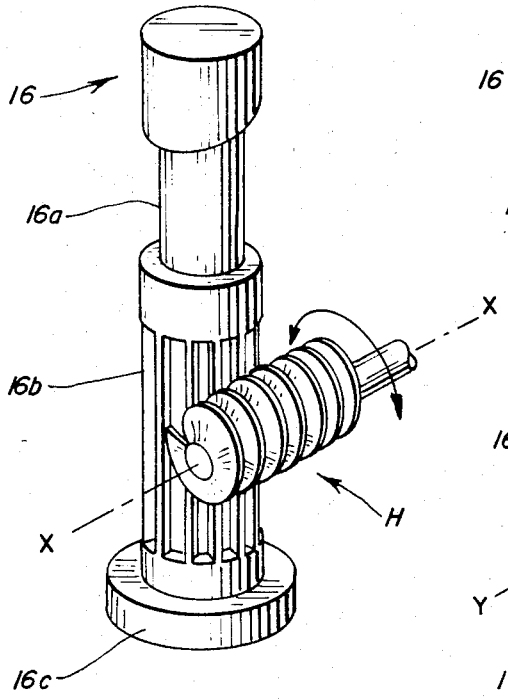
FIG. 6
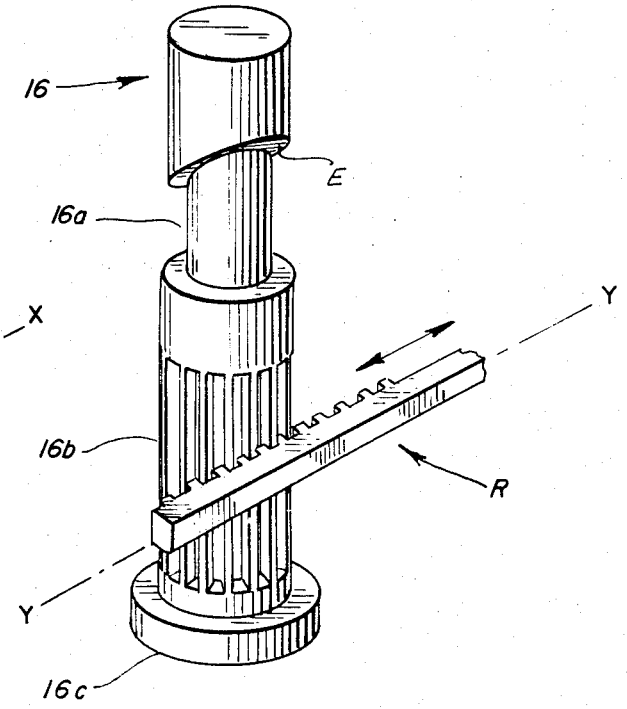
FIG. 7

FUEL INJECTION SYSTEM

BACKGROUND OF THE INVENTION

In multi-cylinder internal combustion engines, varying the timing of the fuel supplied to the various cylinder injectors has a significant impact on the operating efficiency of the engine. Heretofore various systems have been utilized to effect the desired timing variations; however, such systems have been beset with one or more of the following shortcomings: (a) they were of a costly and complex construction; (b) they were highly susceptible to malfunction and required an inordinate amount of maintenance and service by a skilled mechanic; (c) various components of the systems were subjected to excessive wear; and (d) each of the systems embodied an inordinate number of components making the installation thereof on the engine an awkward, frustrating and time-consuming operation.

SUMMARY OF THE INVENTION

Thus, it is an object of the invention to provide an improved fuel injection system which effectively overcomes the aforenoted shortcomings of prior systems of this general type.

It is a further object to provide an improved fuel injection system which may be readily adapted for use in an internal combustion engine having each cylinder thereof provided with either a single fuel injector or a pair of injectors and where primary and secondary fuels are used simultaneously in the engine.

It is a still further object to provide an improved fuel injection system wherein a single plunger functions in a dual capacity of charging a fluid accumulator and of controlling the timing of intermittent exposure of various metering plungers for the cylinder injectors to the accumulator pressure whereby one or more fuels are supplied to each cylinder injector.

It is a still further object to provide an improved fuel injection system which is adapted from use in an internal combustion engine utilizing a single fuel or a variety of fuels simultaneously.

It is a still further object to provide an improved fuel injection system wherein a single accumulator for high pressure fluid, a single pumping and timing plunger, and a single accumulator pressure control valve may be utilized for all the cylinder injectors embodied in the engine.

Further and additional objects will appear from the description, accompanying drawings, and appended claims.

In accordance with one embodiment of the invention, a fuel injection system is provided embodying a source of fluid and a first chamber in which is disposed a reciprocating cam-operated pumping and timing plunger. The chamber is connected to the fluid source and the reciprocating plunger maintains a predetermined high fluid pressure within an accumulator. The plunger is mounted within the first chamber so that it may be rotated about its longitudinal axis and depending upon its relative position of rotation, the timing of the intermittent application of the accumulator fluid pressure on a metering plunger disposed within a second chamber can be varied in response to the operating demands imposed upon the engine. The opposite end of the metering plunger coacts with the second chamber to define a cavity in which fuel is accumulated when the metering plunger is not exposed to the accumulator fluid pressure. When the metering plunger is actuated by the accumulator fluid pressure, the fuel is discharged from the cavity to the cylinder injector connected thereto. Rotational adjustment of the pumping and timing plunger is effected by means independent of the cam actuating the plunger.

For a more complete understanding of the invention, reference should be made to the drawings wherein:

FIGS. 1–5 are fragmentary schematic diagrams of various embodiments of the improved fuel injection system.

FIG. 6 is an enlarged fragmentary perspective view showing one embodiment of a means for imparting rotational adjustment to the pumping and timing plunger.

FIG. 7 is similar to FIG. 6 but showing a second embodiment of a means for imparting rotational adjustment to the pumping and timing plunger.

FIG. 8 is a fragmentary schematic view of a portion of the FIG. 1 embodiment which has been modified to provide two separate vents, one for the accumulator fluid and the second for the injector fuel.

Referring now to the drawings and more particularly to FIG. 1, one form of the improved fuel injection system 10 is shown which is adapted for use in a multi-cylinder internal combustion engine wherein each cylinder is provided with a single fuel injector 11 of conventional design. In the system 10 depicted in FIG. 1, only a primary (diesel) fuel is supplied to each injector.

System 10 includes a source of fluid 12 which may be the same as the source P of primary fuel or an independent source of another fluid. The fluid source 12 is connected by a first rail 14 to one end portion 15*a* of a chamber 15 in which is mounted a reciprocating pumping and timing plunger 16. Also connected to the chamber end portion 15*a* is a first segment 17*a* of a second rail 17 which extends to a high pressure accumulator 18 for the fluid.

Disposed within the first rail 14 is an accumulator pressure control valve 20 which includes a reciprocating plunger 20*a* mounted within a suitable cylinder 20*b*. Rail 17 is also provided with a second segment 17*b* extending from segment 17*a* to an end portion 20*c* of cylinder 20*b*. A third segment 17*c* of rail 17 extends from segment 17*a* to a central portion of chamber 15. The connection between the rail segment 17*c* and the chamber 15 is axially spaced from the connection between the rail segment 17*a* and the chamber 15.

A section of the central portion of cylinder 20*b* is connected to an end segment 14*a* of rail 14 and a second section of the central portion is directly connected to the fluid source 12. The connections of the rail segment 14*a* and the fluid source to cylinder 20*b* are annularly spaced from one another and are interconnected by way of a groove 20*d* which is formed in and encompasses the exterior of the plunger 20*a*, when plunger 20*a* assumes its normal position within the cylinder, see FIG. 1. Plunger 20*a* is preferably biased to assume its normal position by a spring 21, the tension of which may be varied by any suitable means, not shown. A safety relief valve 22 is also provided in rail segment 17*b* and is set to relieve rail pressure when the latter exceeds a predetermined amount. Once a desired fluid pressure (e.g. 18,000 psi) has developed within accumulator 18, such pressure is reflected in rail 17, whereupon the upper end of plunger 20*a* will be exposed to such pressure causing the plunger to move away from its normal position until the groove no longer effects interconnection between the fluid source 12 and rail segment 14*a*.

Both rail segments 14*a* and 17*a* are provided with conventional check valves 23, 24, respectively. Valve 23 prevents reverse flow of the fluid from chamber 15 to cylinder 20*b* when the plunger 16 is moving towards the chamber end portion 15*a*. Valve 24, on the other hand, prevents reverse flow of the high pressure fluid through the second rail segment 17*a* to the chamber end portion 15*a*.

It should be noted that the end 14*b* of rail 14 is connected to chamber 15 at a location which is axially spaced from the connection between the chamber and rail segment 17*a*. Also connected to the chamber 15 at the central portion thereof are corresponding ends 25*a*, 26*a* of third and fourth rails 25, 26, respectively. Ends 25*a*, 26*a* are axially spaced from each other as well as from the connection of rail segment 17*c* with the chamber.

Rail 25 extends from chamber 15 to one end of a chamber 27 in which is mounted a reciprocating fuel metering plunger 28. The end of the plunger 28, which is remote from rail 25, coacts with chamber 27 to form a cavity C in which a metered amount of fuel is collected when the plunger 28 is not exposed to the accumulator fluid pressure, as will be described more fully hereinafter.

Rail 26 extends from chamber 15 and has one section 26*b* thereof connected to the central portion of chamber 27 and a second section 26*c* connected to a suitable vent or fluid collection tank, not shown.

A fifth rail 30 is provided which interconnects chamber 27 and to the tip of the conventional cylinder fuel injector 11. Rail 30 has a first end section 30*a* which is connected to the central portion of chamber 27 and a second end section 30*b* connected to the cavity C. The connections of the first and second end sections of rail 30 to the chamber 27 are in axially spaced relation to each other and to the connection between the chamber 27 and rail section 26*b*.

Also connected to the cavity-forming end portion of chamber 27 is an end 31*a* of a sixth rail 31. The rail 31 is connected to a source of primary fuel P. Thus, when the plunger 28 is not exposed to the accumulator fluid pressure, the fuel entering cavity C through rail 31 will cause the plunger 28 to move toward the position shown in FIG. 1; the amount of movement being dependent upon the amount of fuel being metered through rail 31. While the plunger is being moved by the pumped fuel, a measured amount of fuel will accumulate within the formed cavity.

Plunger 28 is provided with an external, encompassing groove 28*a* having an axial dimension, or length, whereby such groove will effect interconnection between rail segment 26*b* and rail segment 30*a* when the plunger 28 has moved a predetermined amount towards cavity C discharging into the injector 11, through rail 30, the fuel accumulated in said cavity.

In order to expose the metering plunger 28 to the accumulator fluid pressure, an external groove 16*a* is formed in plunger 16. The axial length of groove 16*a* is non-uniform by reason of the end E of the groove being sloped; however, the minimum axial length thereof is at least equal to axial spacing L between the centers of the connections of the rail third section 17*c* and the rail end 25*a* with chamber 15. Thus, the effective length of groove 16*a* with respect to these two rail connections may be increased, or varied, by rotating the plunger 16 a predetermined amount about its longitudinal axis. Groove 16*a* encompasses, or at least partially encompasses, the exterior of the central portion of plunger 16.

Two modes for effecting rotational adjustment of plunger 16 are shown in FIGS. 6 and 7. In both modes a portion 16*b* of the plunger which is axially spaced downwardly from groove 16*a* is provided with a plurality of symmetrically arranged longitudinally extending external splines. The splines are in continuous meshing engagement with either a helix gear H (FIG. 6) or an elongated rack R (FIG. 7). The helix gear is mounted for rotation about an axis X—X which is angularly disposed relative to the longitudinal axis of plunger 16. The rack R, on the other hand, is movable endwise along an axis Y—Y which also is angularly disposed relative the plunger longitudinal axis. Movement of either the helix gear H or the rack R may be made responsive to the operating demands of the engine in any suitable manner.

Longitudinal movement of plunger 16 within chamber 15 is effected by a cam 32 mounted on a cam shaft which, in turn, may be driven in a conventional manner by the crankshaft, not shown, of the engine. The periphery of the cam is in continuous engagement with an end 16*c* of plunger 16 by a biasing spring 33 which encompasses a segment of portion 16*b* of the plunger projecting endwise from the chamber 15. One end of spring 33 engages a surface K of a housing in which the chamber 15 is formed and the opposite end of spring 33 engages a shoulder formed at the plunger end 16*c*. The axial lengths of the splines are such as to allow full camactuated longitudinal movement of the plunger while maintaining a continuous meshing relationship between the splines and either gear H or rack R.

FIG. 8 shows a modification of the FIG. 1 embodiment 10 wherein it is desirable to separate the fluid used in charging the accumulator 18 from the fuel for the injector 11 during the venting sequence. To accomplish this result, two separate vents A and B are provided. Vent A may go to the fuel source P and vent B may be connected to fluid source 12. Where source 12 is a lubricating oil, vent B may be connected to the engine crankcase, not shown. As seen in FIG. 8, vent B is connected to the central portion of chamber 15 by rail 26 and vent A is connected directly to the central portion of chamber 27 by a rail 26'. Rails 26 and 26' are separate from one another and thus, there is no comingling of the fluid and fuel. Two separate vents may be utilized, if desired, in the various embodiments of the improved fuel systems to be hereinafter described.

A second embodiment 110 of the improved fuel injection system is shown in FIG. 2 which differs from system 10 (FIG. 1) in that two fuel sources P and S are provided. Source P supplies the primary fuel (e.g., diesel oil) to the injector 11 and source S supplies a secondary fuel (e.g., alcohol) also to the same injector 11. All the corresponding components of systems 10 and 110 are given the same identifying number where possible. The source S of secondary fuel is substituted for the fuel source P in system 10 whereupon the secondary fuel flows into cavity C through rail 31 when the metering plunger 25 moves to the opposite end of chamber 27. From source P a metered amount of primary fuel flows directly to the injector 11 through a seventh rail 34. A check valve 35 is provided in the sixth rail 31 in both systems 10 and 110 and a similar check valve 36 is provided in the seventh rail 34. In system 110 the primary and secondary fuels will assume a stacked relation relative to the injector 11 whereby a metered amount of one of the fuels will be supplied to the injector 11 ahead of the other fuel.

FIG. 3 discloses a third embodiment 210 of the improved system and the components thereof corresponding to like components of system 10 will be given the same identifying numbers. As in the case of system 110, system 210 utilizes two fuel sources P and S from which metered amounts of primary and secondary fuels are supplied to the injector of each engine cylinder. In system 210, a second metering chamber 37 is provided in which a reciprocating plunger 38 is mounted. The cylinder 37 is arranged so that a cavity C', formed at one end portion thereof is in communication with segments 40*a*, 40*b* of a rail 40. Rail segment 40*a* extends from fuel source S to the cylinder cavity C', and rail segment 40*b* extends from cavity C' to injector 11. A check valve 41 is disposed in rail segment 40*a* and prevents reverse flow of the secondary fuel when the latter is being discharged under high pressure by plunger 38 moving from its normal position, shown in FIG. 3, toward the cavity C' under the influence of the accumulator fluid pressure being exerted on the opposite end 38*a* of the plunger, as will be described more fully hereinafter.

It will be noted in FIG. 3 that third rail 25 has one end portion 25*a* connected to the central portion of chamber 15. The opposite end portion of rail 25 is provided with a first section 25*b* connected directly to one end of metering chamber 27; a second section 25*c* extending from section 25*b* to the end portion of chamber 37 which is opposite from cavity C'; and a third section 25*d* which extends from second section 25*c* to the central portion of chamber 27. A conventional check valve 42 is provided in rail section 25*c* between the junction of sections 25*b*, 25*c*, and the junction of sections 25*c*, 25*d*.

Interconnecting the central portions of metering chambers 27, 37 is an eighth rail 43. The connections of the rail section 25*d* and rail 43 with chamber 27 are in axially spaced relation. A similar axial spacing exists between the connections of the first and second segments 30*a*, 30*b* of fifth rail 30 with chamber 27. When plunger 28 is at the end of its pumping stroke, that is to say the primary fuel has been discharged from cavity C, the rail sections 25*b*, 25*d* will become interconnected allowing the accumulator fluid pressure to be exerted on the end of plunger 38 causing the latter to move to the right and effect discharge of the secondary fuel collected in chamber cavity C' into injector 11. When plungers 28 and 38 have moved to the right the full amount, rail segment 30*a* and rail 43 will become interconnected by reason of plunger groove 28*a*, thereby venting the rails 30 and 43 of any remaining fuel through the groove in plunger 38.

FIG. 4 discloses a fourth version 310 of the improved fuel injection and is basically the same as system 210, except that rather than have the secondary fuel being discharged directly from the chamber cavity C' to the cylinder injector 11 through rail segment 40*b*, the secondary fuel comingles with the primary fuel in rail 30 before being supplied to the injector 11. Thus, as seen in FIG. 4, rail segment 40*b* leading from chamber cavity C' joins rail 30 leading from chamber cavity C upstream of the connection of rail 30 to the injector 11. In some instances it might be more desirable to have the comingling of the fuels occur within the injector itself as is the case in system 210.

FIG. 5 illustrates the utilization of a modified version of system 410 in an engine wherein each cylinder thereof is provided with two fuel injectors 11, 11*a*, one being for a primary fuel and the other being for a secondary fuel. As in the previously described systems 10, 110, 210, and 310, the corresponding pumping and timing plunger 16, accumulator 18, accumulator pressure control valve 20, and associated rails 14, 17 are the same in system 410 and thus, the same identifying numbers are utilized.

The metering chamber 27 and plunger 28 and the arrangement of the connections to chamber 27 of rails 25, 30, 31, and 43 is the same as that previously described with respect to system 310. Likewise, the arrangement of the connection to the chamber 37 of rail 26 in system 310 is also the same in system 410. The principal differences between the systems 310, 410, besides the fact that two injectors per cylinder are involved in system 410, are that: (a) rail 43 extends from the central portion of chamber 27 to a junction with rail 26 which is upstream from the connection of rail segment 26*b* with chamber 37; (b) rail 40 extends directly from chamber cavity C' to the second injector 11*a*; and (c) rail 40 has a first end section 40*a* which is connected to a central portion of chamber 37 and a second end section 40*b* which is connected to the chamber end portion in which cavity C' is formed.

The operation the metering chambers 27, 37 and plungers 28, 38 in system 410 is as follows: (1) upon rail 25 being charged with the accumulator fluid pressure, plunger 28 will move to the right end of chamber 27, causing the primary fuel collected in cavity C to be discharged to injector 11 through rail segment 30*b*; (2) once plunger 28 has moved a predetermined distance to the right (as viewed in FIG. 5), the rail sections 25*b*, 25*d* will become interconnected allowing the accumulator fluid pressure to be exerted on the end of plunger 38 causing the latter to move to the right and effect discharge of the secondary fuel collected in chamber cavity C' into injector 11*a*; (3) when the plunger 28 has moved to the right the full amount, rail segment 30*a* and rail 43 will become interconnected by reason of plunger groove 28*a*, thereby venting the rails 30 and 43 of any remaining primary fuel; (4) likewise when plunger 38 has moved fully to the right, rails 40*a* and 26*b* will be interconnected by groove 38*a*, thereby venting rail 40; (5) when timing and pumping plunger 16 reaches its fully down position as seen in FIG. 5, rails 25*a* and 26 are interconnected by groove 16*a* thereby venting rail 25; (6) once rails 25, 26, and 43 have been vented, the fuel pressure for pumping the fuels from sources P and S will be sufficient to return the respective plungers 28, 38 to their normal relative positions as seen in FIG. 5 whereupon the cycle is repeated upon plunger 16 being raised by cam 32 so as to effect interconnection of rail section 17*c* with rail end 25*c* through plunger groove 16*a*.

In all versions of the improved systems 10, 110, 210, 310, and 410 as heretofore described, the plunger 16 functions in a dual capacity; namely, it repeatedly recharges the accumulator to a predetermined fluid pressure, and secondly, it controls the timing when the fuel or fuels are to be fed to the injector, or injectors, of each cylinder. As previously mentioned, the timing function of plunger 16 can be readily varied by changing the position of rotation of the plunger within chamber 15. In addition all of the improved systems heretofore described utilize the pressure control valve 20 which maintains the accumulator 18 at a desired pressure by varying the amount of fluid introduced through rail 14 into the end portion 15*a* of the chamber 15 for each stroke of plunger 16. This latter effect is accomplished by varying the registration of the groove 20*d* relative to the connections of cylinder 20*b* to fluid source 12 and rail segment 14*a*. The advantages derived from the use of the valve plunger 20*c* over using a conventional constant high pressure relief valve is that with the latter it is less durable and more pumping energy would be expended by plunger 16.

The arrangement of the rail connections in the chambers 27, 37, and the length of the external grooves formed in the respective plungers 28, 38 assures sharp cutoff of the fuel supplied to the cylinder injectors.

While a helix gear and elongated rack have been described as alternative means for effecting controlled rotational adjustment of plunger 16, other mechanical or hydraulic means may be utilized for this purpose if desired. Furthermore, the improved system allows a single fluid accumulator, a single cam-operated pumping and timing plunger, and a single accumulator pressure relief valve to be utilized for all the cylinders of an internal combustion engine regardless of whether each cylinder is provided with one or more injectors.

Thus, it will be noted that an improved fuel injection system has been provided which is of simple construction; is easy to install on a variety of internal combustion engines; requires a minimum amount of service; and is easy to adjust so as to vary the timing when the fuel is supplied to a cylinder injector in response to the operational demands imposed on the engine.

I claim:

1. A fuel injection system for a multi-cylinder internal combustion engine having a pair of fuel injectors for each cylinder, said system comprising a source of fluid; a high pressure accumulator for the fluid; a first plunger mounted for reciprocatory movement within a first chamber; a power actuated cam responsive to the operating demands of the engine and movably engaging a first portion of said first plunger and effecting controlled axial movement of the latter toward one end portion of said first chamber; a first rail extending from said fluid source to said chamber one end portion, fluid flowing to said chamber one end portion when said first plunger has moved away from said chamber one end portion; a second rail extending from said chamber one end portion to said accumulator, fluid flowing through said second rail to said accumulator only when said first plunger is moving in a direction toward said chamber one end portion; a primary fuel metering second plunger mounted for reciprocatory movement within a second chamber; a third rail connected to said first chamber at a location axially spaced from the connections of said first and second rails to said first chamber, said third rail having a first section extending to one end portion of said second chamber and a second section extending to one end portion of a third chamber and to a central portion of said second chamber; a secondary fuel metering third plunger mounted for reciprocatory movement within said third chamber; a fourth rail connected to said first chamber at a location axially spaced a greater distance from the first chamber one end portion than said third rail and having a first segment extending to a central portion of said second chamber, a second segment extending to a vent, and a third segment extending to a central portion of said third chamber; a fifth rail extending from said second chamber to one of the pair of cylinder fuel injectors, said fifth rail having a first segment connected to the central portion of said second chamber and a second segment connected to a second end portion of said second chamber; a sixth rail connected to the second end portion of said second chamber and extending to a source of primary fuel, the second segment of the fifth rail and the sixth rail being in communication with one another when the second plunger assumes a first relative position within the second chamber; a seventh rail connected to a second end portion of said third chamber and extending to a source of secondary fuel; an eighth rail having a first segment connected to the central portion of the third chamber and a second segment connected to the second end portion of the third chamber; said eighth rail extending to a second of the pair of cylinder fuel injectors; a first groove formed in and encompassing the exterior of said first plunger and having a non-uniform axial dimension, the minimum axial dimension being at least as great as the axial spacing between the second and third rail connections to said first chamber and as great as the axial spacing between the third and fourth rail connections to said first chamber; a second groove formed in the exterior of the second plunger, the axial dimension of said second groove being at least as great as the axial spacing between the connections of the first segment of the fourth rail and the first segment of the fifth rail with said second chamber; a third groove formed in the exterior of the third plunger, the axial dimension of said third groove being at least as great as the axial spacing between the connections of the third segment of the fourth rail and the first segment of the eighth rail with the third chamber; and adjustable means engaging said first plunger for effecting selective movement of the latter about its longitudinal axis whereby the effective axial length of the first groove of said first plunger varies relative to said second and third rail connections to said first chamber.

2. A fuel injection system for a multi-cylinder internal combustion engine having at least one fuel injector for each cylinder, said system comprising a cam-operated first plunger disposed within a first chamber for maintaining a predetermined fluid pressure within an accumulator connected to both one end portion and a central portion of said first chamber and for controlling the intermittent application of the accumulator fluid pressure on one end of a metering second plunger during a pumping stroke of the first plunger, said metering second plunger being disposed within a second chamber, the latter having one end portion thereof connected to the first chamber at a location axially spaced a greater distance from the first chamber end portion than the accumulator connections, the opposite end of the second chamber coacting with the opposite end of said second plunger to form a cavity in which a predetermined amount of fuel from a fuel source accumulates during time intervals when said second plunger is not exposed to the accumulator fluid pressure, the said opposite end of said second chamber being connected to an inlet of a fuel injector; said first plunger having an external axially extending groove which at least partially encompasses same; the groove end closest to the first chamber one end portion being sloped relative to the plunger axis whereby, upon controlled rotation of the first plunger about said axis, the effective length of the groove relative to the connections to the first chamber of the accumulator and metering second chamber is varied thereby changing the timing of interconnecting the accumulator and second chamber one end portion during the pumping stroke of said first plunger and the discharge of the fuel accumulated in the cavity to the fuel injector; and independently adjustable means for controlling rotation of said first plunger.

3. The fuel injection system of claim 2 wherein the one end portion of said first chamber communicates with a pressure relief means.

4. The fuel injection system of claim 2 wherein one end of said first chamber is connected by a first rail to a source of fluid.

5. The fuel injection system of claim 4 wherein the first rail includes a control valve responsive to the fluid pressure within the accumulator.

6. The fuel injection system of claim 2 wherein said first plunger is spring biased to continuously engage the periphery of a power actuated cam.

7. The fuel injection system of claim 5 wherein the control valve is biased to normally assume an open position.

8. The fuel injection system of claim 2 wherein the fuel injector is connected to a second source of fuel.

9. The fuel injection system of claim 8 wherein one of the fuel sources is for a primary fuel and the other source of fuel is for a secondary fuel.

10. The fuel injection system of claim 8 wherein the fuel flows from the second source to the fuel injector in a metered amount.

11. The fuel injection system of claim 10 wherein the flow of one fuel precedes the flow of the other fuel to the fuel injector.

12. The fuel injection system of claim 4 wherein the fuel source includes the source of fluid.

13. The fuel injection system of claim 1 wherein rotating of said first plunger about its longitudinal axis is effected by an independently actuated helical gear rotatably engaging an externally splined portion of said first plunger.

14. The fuel injection system of claim 2 wherein rotating of said first plunger about its longitudinal axis is effected by an independently actuated elongated rack movable in an endwise direction; said rack being in meshing relation with an externally splined portion of said first portion.

15. The fuel injection system of claim 2 wherein a central portion of the second chamber is connected to a first vent and the second plunger is provided with an external axially extending groove which interconnects the fuel injector inlet and the first vent when the second plunger has discharged the accumulated fuel in the cavity to the fuel injector.

16. The fuel injection system of claim 15 wherein a central portion of the first chamber is connected to a second vent; the external groove of said first plunger interconnecting the one end portion of the second chamber to said second vent when said first plunger has moved the furthest away from the one end portion, of said first chamber.

17. A fuel injection system for a multi-cylinder internal combustion engine having at least one fuel injector for each cylinder, said system comprising a source of fluid; a high pressure fluid accumulator; a reciprocating first plunger mounted within a first chamber; a power actuated cam responsive to the operating demands of the engine and movably engaging a first portion of said first plunger and effecting controlled axial movement of the latter toward one end portion of said first chamber; a first rail extending from said fluid source to said chamber one end portion, fluid flowing to said one end portion when said plunger has moved away from said one end portion; a second rail having a first section extending from said chamber one end portion to said accumulator, fluid flowing through said first section to said accumulator only when said plunger is moving in a direction toward said chamber one end portion, said second rail having a second section connected to said chamber at a location axially spaced from said one end portion; a fuel metering second plunger mounted for reciprocatory movement within a second chamber; a third rail connected to said first chamber at a location axially spaced from the connections of said second rail to said first chamber, said third rail extending to one end portion of said second chamber, a fourth rail connected to said first chamber at a location axially spaced a greater distance from the first chamber one end portion than said third rail connection and having a first segment extending to a central portion of said second chamber and a second segment extending to a vent; a fifth rail extending from said second chamber to the cylinder fuel injector, said fifth rail having a first segment connected to the central portion of said second chamber and a second segment connected to a second end portion of said second chamber; a sixth rail connected to the second chamber second end portion and extending to a first source of fuel; a first groove formed in and at least partially encompassing the exterior of said first plunger and having a non-uniform axial dimension, the minimum axial dimension being at least as great as the axial spacing between the second and third rail connections to said first chamber and as great as the axial spacing between the third and fourth rail connections to said first chamber, the end of said groove adjacent the first chamber one end portion defining a substantially oblique plane relative to the longitudinal axis of said first plunger, said groove effecting interconnection of said second and third rails when said first plunger is in predetermined first positions within said first chamber and effecting interconnection of said third and fourth rails when said first plunger is in predetermined second positions within said first chamber; a second groove formed in the exterior of the second plunger, the axial dimension of said second groove being at least as great as the axial spacing between the connections of the first segment of the fourth rail and the first segment of the fifth rail with said second chamber; and adjustable means engaging said first plunger for effecting selective movement of the latter about its longitudinal axis whereby the effective axial length of the first groove of said first plunger varies relative to said second and third rail connections to said first chamber.

18. The fuel injection system of claim 17 wherein the fuel injector is connected to a second source of fuel by a seventh rail and the third rail includes a first section extending to one end portion of said second chamber and a second section extending to one end portion of a third chamber and to a central portion of said second chamber; an elongated third plunger being mounted for reciprocatory movement within said third chamber and provided with an external third groove; an eighth rail extending from a central portion of the third chamber to the central portion of the second chamber; said fourth rail having the first segment thereof connected to the central portion of the third chamber; the fourth rail first segment communicating with the eighth rail when the third plunger assumes a predetermined first position within said third chamber; a ninth rail extending from a second end portion of said third chamber to the fuel injector; said seventh rail extending from the second source of fuel to the second end portion of said third chamber, said seventh and ninth rails communicating with one another when the third plunger assumes a predetermined second position within said third chamber.

19. The fuel injection system of claim 18 wherein the axial length of the second groove is at least as great as the axial spacing between the eighth rail and the fifth rail first segment connections with the second chamber.

20. The fuel injection system of claim 19 wherein, when the second plunger is in a position so that the second groove effects communication between the eighth rail and the second segment of the third rail, the third plunger blocks communication between the eighth rail and the first segment of the fourth rail.

21. The fuel injection system of claim 18 wherein the ninth rail connects with the fifth rail upstream from the connection of the fifth rail with the cylinder fuel injector.

22. The fuel injection system of claim 18 wherein the fifth rail and the ninth rail are each connected directly to the cylinder fuel injector.

23. The fuel injection system of claim 18 wherein the sixth and seventh rails are each provided with valve means for allowing fuel flow therein in only one direction away from the source of fuel to which the rail is connected.

* * * * *